US009314661B1

(12) United States Patent
Chen

(10) Patent No.: US 9,314,661 B1
(45) Date of Patent: Apr. 19, 2016

(54) PIVOTAL UNIT FOR BARBELL

(71) Applicant: Jih Ming Chen, Taichung (TW)

(72) Inventor: Jih Ming Chen, Taichung (TW)

( * ) Notice: Subject to any disclaimer, the term of this patent is extended or adjusted under 35 U.S.C. 154(b) by 0 days.

(21) Appl. No.: 14/684,316

(22) Filed: Apr. 10, 2015

(51) Int. Cl.
*A63B 21/072* (2006.01)
*A63B 21/075* (2006.01)
*A63B 21/00* (2006.01)
*A63B 23/16* (2006.01)

(52) U.S. Cl.
CPC ..... *A63B 21/0728* (2013.01); *A63B 21/0724* (2013.01); *A63B 21/072* (2013.01); *A63B 21/075* (2013.01); *A63B 21/4047* (2015.10); *A63B 21/4049* (2015.10)

(58) Field of Classification Search
CPC ..... A63B 21/00; A63B 21/06; A63B 21/072; A63B 21/0724; A63B 21/0728; A63B 21/075; A63B 21/078; A63B 21/0783; A63B 21/08; A63B 21/4033; A63B 21/4035; A63B 21/4041; A63B 21/4047; A63B 21/4049
USPC ..... 482/49–50, 92, 98–104, 106–108
See application file for complete search history.

(56) References Cited

U.S. PATENT DOCUMENTS 4,455,020 A * 6/1984 Schnell ..... A63B 21/0728 482/106
4,579,337 A * 4/1986 Uyeda ..... A63B 21/0728 403/259
5,062,631 A * 11/1991 Dau ..... A63B 21/0728 403/330
5,295,934 A * 3/1994 Collins ..... A63B 21/0728 482/107
6,770,016 B1 * 8/2004 Anderson ..... A63B 21/0724 482/106
7,087,000 B1 * 8/2006 Walker ..... A63B 21/0728 482/106
2014/0045661 A1 * 2/2014 Lien ..... A63B 21/0724 482/108

FOREIGN PATENT DOCUMENTS

CN 201453927 U * 5/2010
GB 2481233 A * 12/2011 ..... A63B 21/0724

* cited by examiner

*Primary Examiner* — Oren Ginsberg
*Assistant Examiner* — Joshua Lee

(57) ABSTRACT

A barbell includes a rod with two tubular members respectively mounted to the two ends thereof. Each tubular member accommodates a pivotal unit which is mounted to the rod. Each pivotal unit has a washer stopped by a shoulder of the tubular member. The washer has an annular recess in one side thereof. A sleeve is rotatably and axial movably mounted to the rod. The sleeve is located between the rollers of the bearing and the rod. The bearing is positioned by a positioning member and an end piece. The annular recess allows the sleeve to move along the rod so that the sleeve is freely rotatable relative to the rollers of the bearing. The sleeve is made by the same material as the rollers. The sleeve contacts the rod by a large area so that when the pivotal unit is rotatable relative to the rod, no noise is generated.

3 Claims, 7 Drawing Sheets

PIVOTAL UNIT FOR BARBELL

The present invention is a Continuation-In-Part patent application of the patent application Ser. No. 13/709,439, filed on Dec. 10, 2012.

FIELD OF THE INVENTION

Background of the Invention

The conventional barbell is used for weight training and generally comprises a rod with two pivotal units mounted to two ends of the rod. Multiple weights are removably connected to the two pivotal units. The user grabs the center of the rod and lifts the barbell to train muscles. The pivotal units ensure that the weights are automatically adjusted to a balance status relative to the rod so that the user does not need to rotate the rod by his/her wrists and this action can easily injure the wrists.

FIGS. 6 and 7 disclose the conventional barbell with a rod 70, and two pivotal units 80 are mounted to the two ends of the rod 70 respectively. Each of the two ends of the rod 70 has a groove 71. Each pivotal unit 80 has a needle roller bearing 72, a first ring 73, two positioning members 74, a second ring 75, two clips 76 and an end piece 77 mounted to the rod 70 and located in the opening 81 of the tubular member of the pivotal unit 80. The two positioning members 74 are two C-shaped members and engaged with the groove 71. The first ring 73 contacts one end of the needle roller bearing 72 and the other end of the needle roller bearing 72 is in contact with a shoulder 82 in the tubular member. The second ring 75 is mounted to the rod 70 and contacts against the positioning members 74. The two clips 76 are positioned in the inner periphery of the tubular member, wherein one clip 76 contacts the second ring 75, and the other clip 76 is in contact with the end piece 77 which is threadedly connected to the opening 81 of the tubular member. By the needle roller bearing 72, the tubular member of the pivotal unit 80 is rotatable relative to the rod 70. The end piece 77 is cooperated with the other clip 76 to seal the end of the barbell.

Because each of the two needle roller bearings 72 has needle rollers 721 located therein, and the material of the needle rollers 721 of the needle roller bearing 72 is harder than that of the rod 70, so that when needle roller bearing 72 is rotatable relative to the rod 70, the harder needle rollers 721 wears out the softer rod 70 after a period of time of use. This makes the surface of the rod 70 to be uneven and gaps are formed between the surface of the rod 70 and the needle rollers 721. Therefore, the pivotal unit 80 cannot smoothly rotate relative to the rod 70 and noise will be generated. Besides, when the user puts the barbell to the floor, the impact makes the needle rollers 721 hit the rod 70 which may form multiple recessed areas in the surface of the rod 70, such that when the needle rollers 721 move over the recessed areas, noise generates. The pivotal unit 80 eventually cannot rotate smoothly relative to the rod 70. Furthermore, when the user puts down the barbell, the impact can shake the two clips 76 which are quickly shifted and/or deformed, such that the second ring 75 cannot be maintained at its position, and the needle roller bearing 72, the first ring 73, the positioning member 74 and the second ring 75 may shift, the whole set of the pivotal unit 80 may collapse. Therefore, the rotation between the pivotal unit 80 and the rod 70 becomes unstable and may have safety concern.

In addition, it is obvious that the two positioning members 74 are difficult to be engaged with the groove 71 of the rod 70 when assembling the barbell. There is no proper positioning design to position the two positioning members 74 so that the assembling processes take a longer time.

Besides, there are too many parts involved in the pivotal unit and the C-shaped clips 76 are thin and not strong enough so that they are easily deformed and the pivotal unit 80 may shift along the rod 70.

U.S. Pat. No. 4,455,020 discloses a rotatable handhold for a barbell and comprises two elastomeric bearing sleeves rotatably mounted to the bar, and the elastomeric bearing sleeves are positioned by using two clips so as to prevent the elastomeric bearing sleeves from axial displacement. In other words, the elastomeric bearing sleeves are not allowed to have axial movement relative to the bar. The elastomeric bearing sleeves actually cannot perform as good as bearings, they are simply a separation means between the bar and the tube section. When the user lifts the barbell, the weights will rotate an angle relative to the bar such that the bar that is held by the user's hand does not need to rotate, the user's wrist is protected. Accordingly, the rotation of the tube section together with the weights is important, the use of the elastomeric bearing sleeves cannot achieve the purpose mentioned above.

The present invention intends to provide a barbell which improves the shortcomings mentioned in the conventional barbell.

SUMMARY OF THE INVENTION

The present invention relates to a barbell and comprises a rod having two ends, and two tubular members are respectively mounted to the two ends of the rod. Each tubular member has two open ends. Two pivotal units are respectively located in the two tubular members and mounted to the two ends of the rod. Each pivotal unit has a first washer, a first bearing, a first sleeve and an end piece positioned in a first end of the tubular member. A second washer, a second bearing and a second sleeve are positioned in a second end of the tubular member. A stop is mounted to the second end of the tubular member to seal the second end of the tubular member so as to prevent the second washer, the second bearing and the second sleeve from dropping from the second end of the tubular member.

The first washer has a first annular recess defined in a first side thereof, and a second side of the first washer is stopped by a shoulder in the inner periphery of the tubular member. The first bearing has first rollers located at the inner periphery thereof. The first sleeve is located in the first bearing and rotatably and axially movably mounted to the rod. The first annular recess is sized to accommodate one end of the first sleeve. The end piece is threadedly connected to inner threads in the first end of the tubular member. The end piece seals the first end of the tubular member and prevents the first washer, the first bearing and the first sleeve from dropping from the first end of the tubular member. The second washer has a second annular recess defined in a first side thereof, and a second side of the second washer is stopped by another shoulder in the inner periphery of the tubular member. The second bearing has second rollers located at an inner periphery thereof. The second sleeve is located in the second bearing and rotatably and axially movably mounted to the rod. The second annular recess is sized to accommodate one end of the second sleeve. Two ends of the second bearing contact against the second washer and the stop. The first and second sleeves are located between the rod and the first and second rollers respectively. When the pivotal unit is rotatable relative to the rod, the first and second sleeves protect the rod from being worn out by the first and second rollers.

Preferably, the rod has a groove defined in each of the two ends thereof. Each pivotal unit has a positioning member which is a C-shaped member and has an opening. The positioning member is engaged with the groove via the opening. Two ends of the first bearing contact against the first washer and the positioning member, and the end piece contacts and pushes the positioning member toward the first bearing.

Preferably, each of the first and second sleeves is made by a material the same as that of the first and second rollers.

The pivotal unit of the present invention ensures that no noise is generated when operating the barbell.

The number of the parts of the pivotal unit of the present invention is reduced so that the barbell can be assembled quickly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
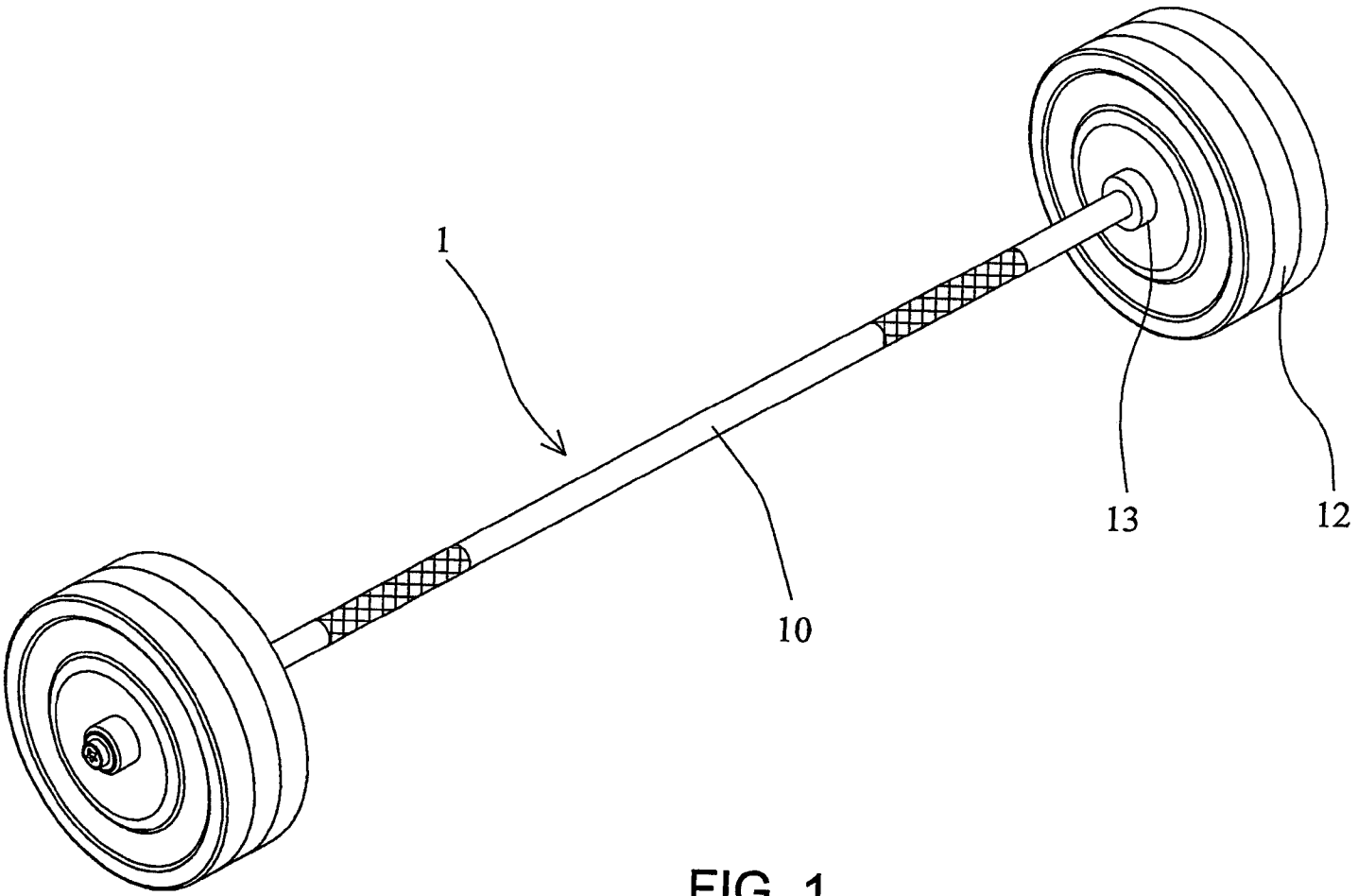
FIG. 1 is a perspective view to show the barbell of the present invention.
Figure 2:
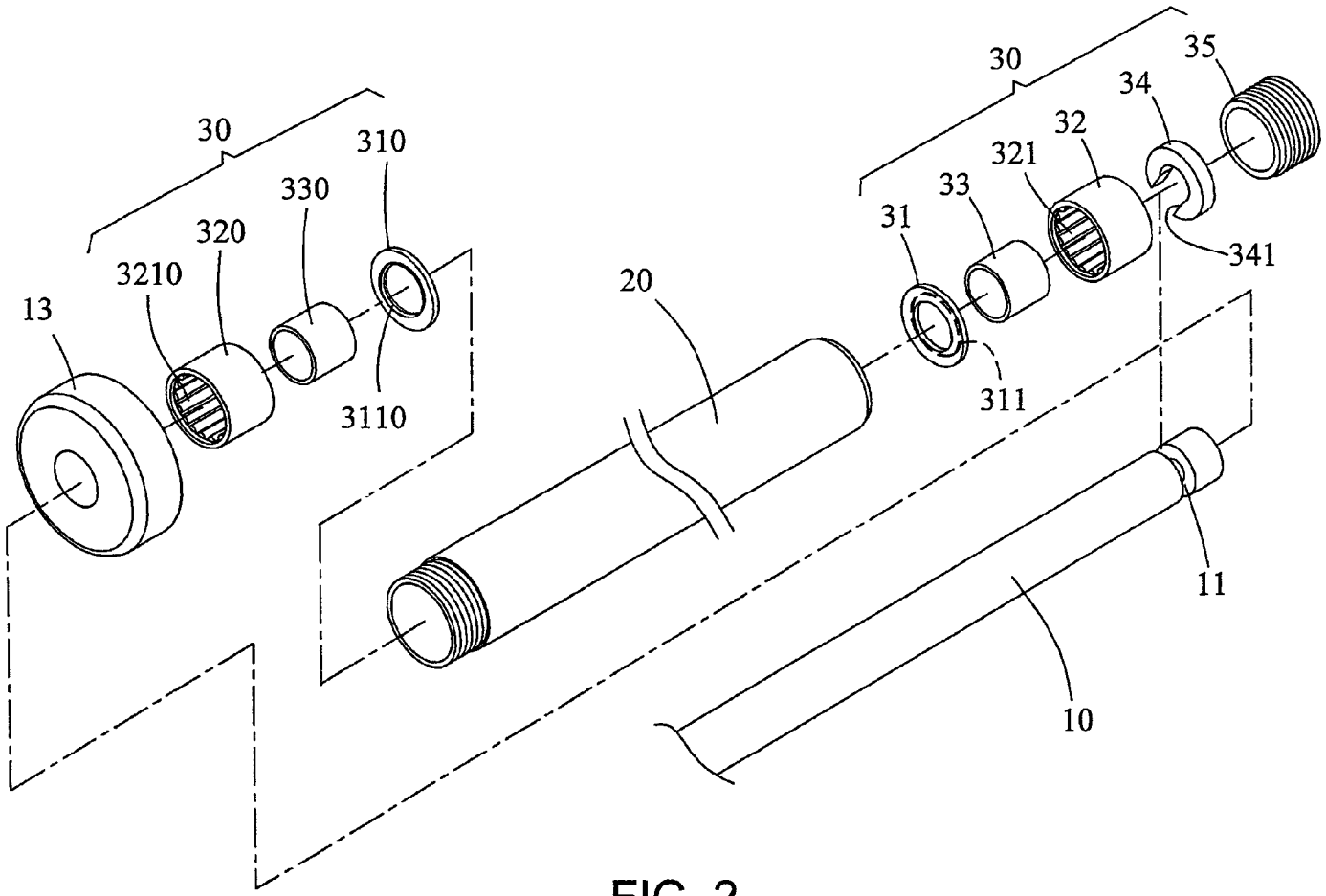
FIG. 2 is an exploded view to show the pivotal unit and the barbell of the present invention.
Figure 3:
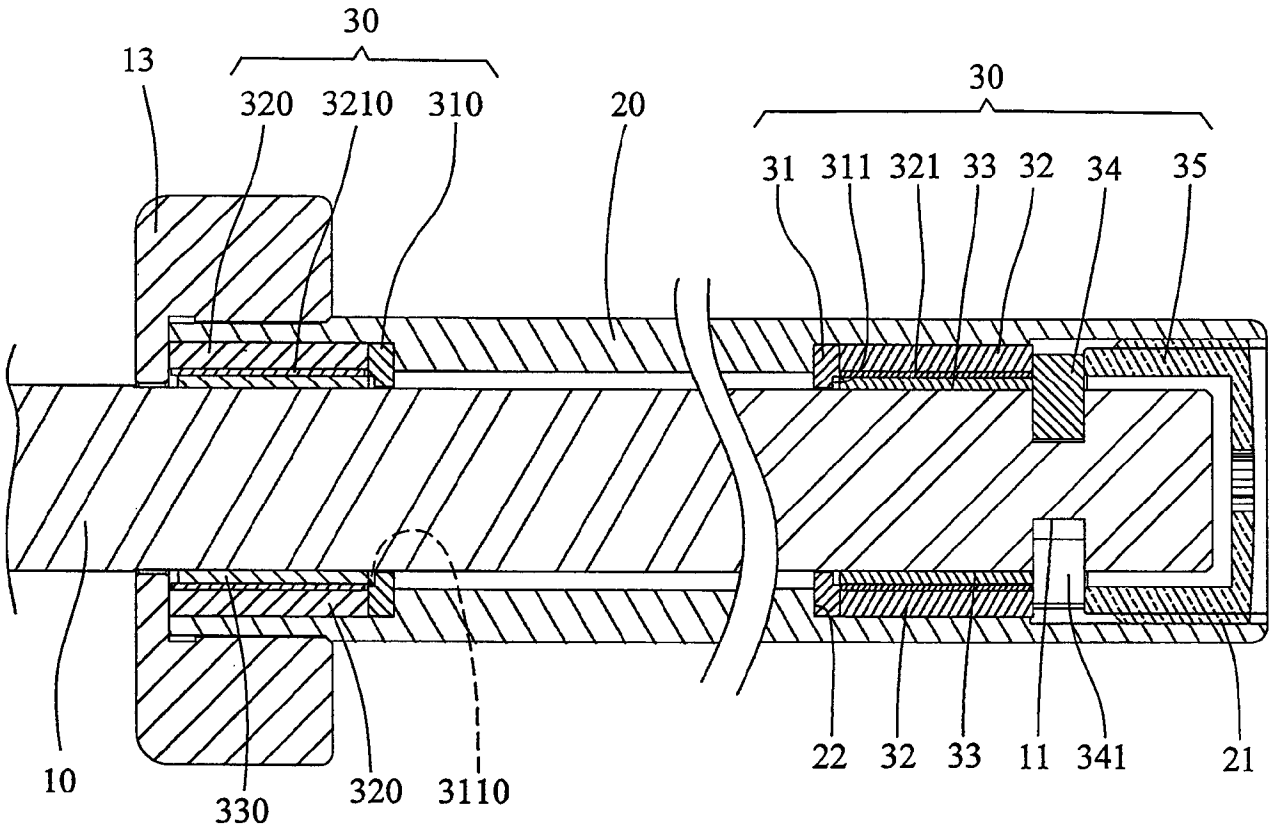
FIG. 3 is a cross sectional view of the pivotal unit and the barbell of the present invention.
Figure 4:
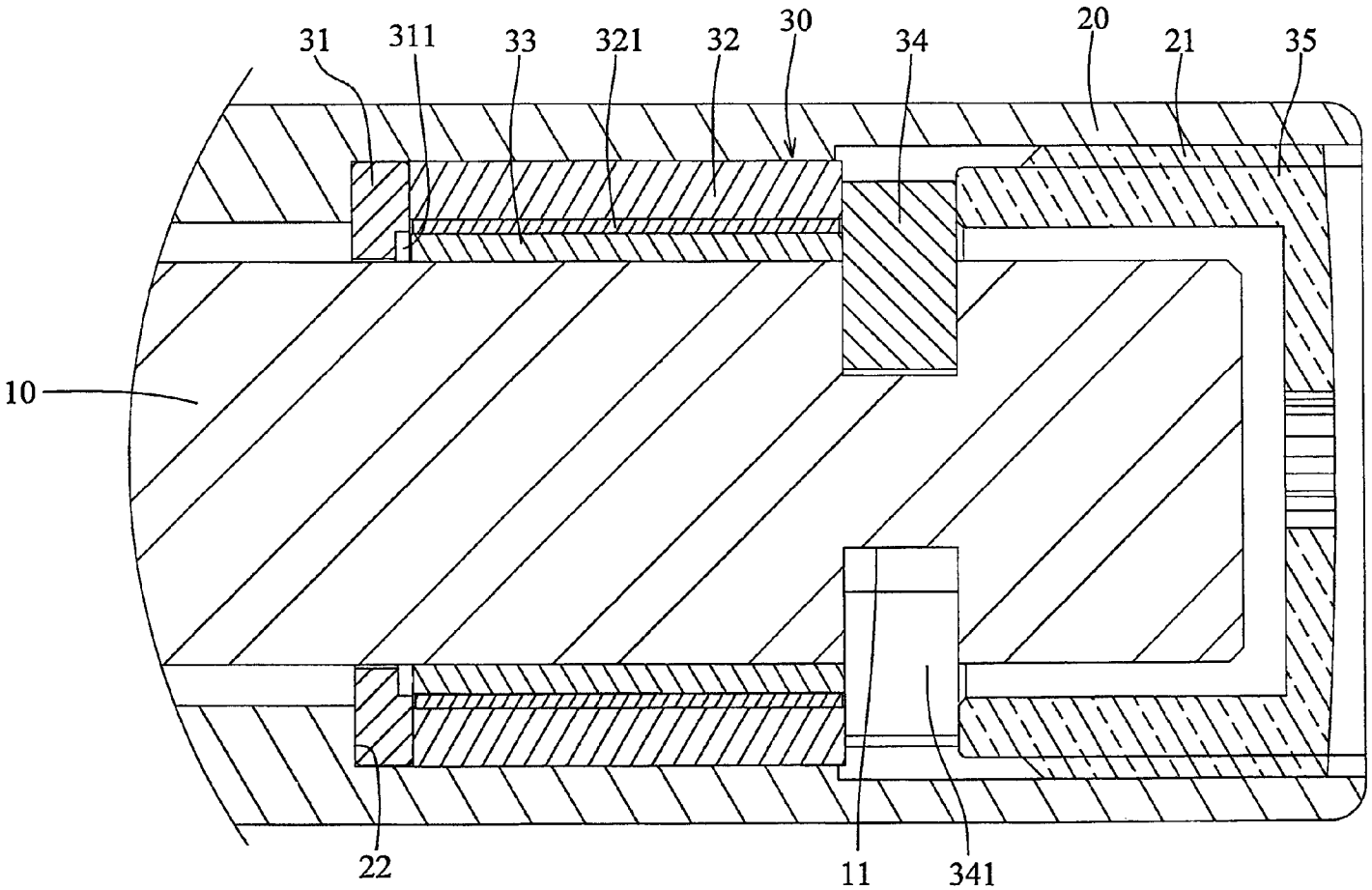
FIG. 4 is an enlarged cross sectional view of the pivotal unit of the barbell of the present invention, wherein the sleeve is not yet moved to the annular recess of the washer.
Figure 5:
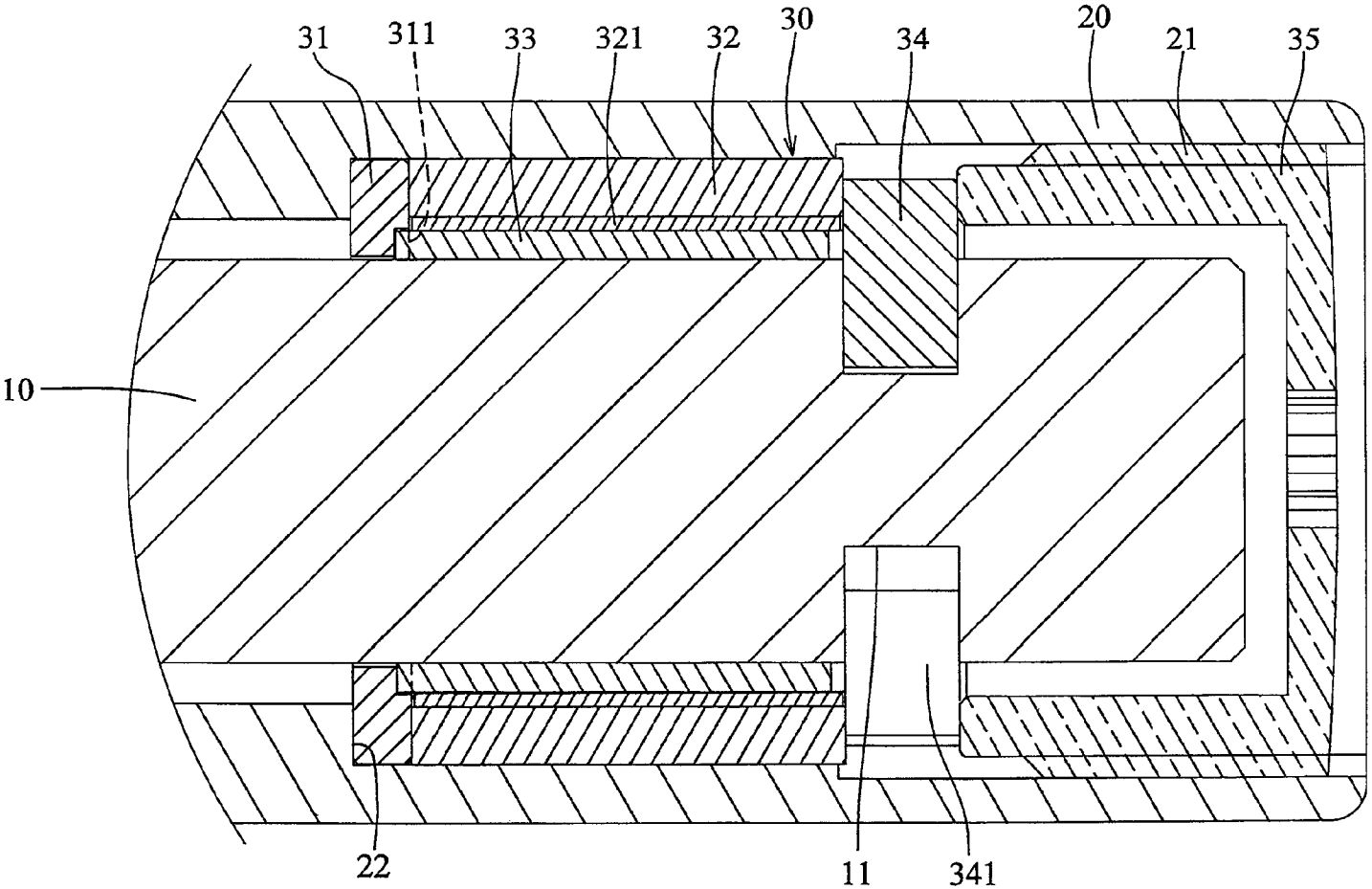
FIG. 5 is an enlarged cross sectional view of the pivotal unit of the barbell of the present invention, wherein the sleeve is moved to the annular recess of the washer.
Figure 6:
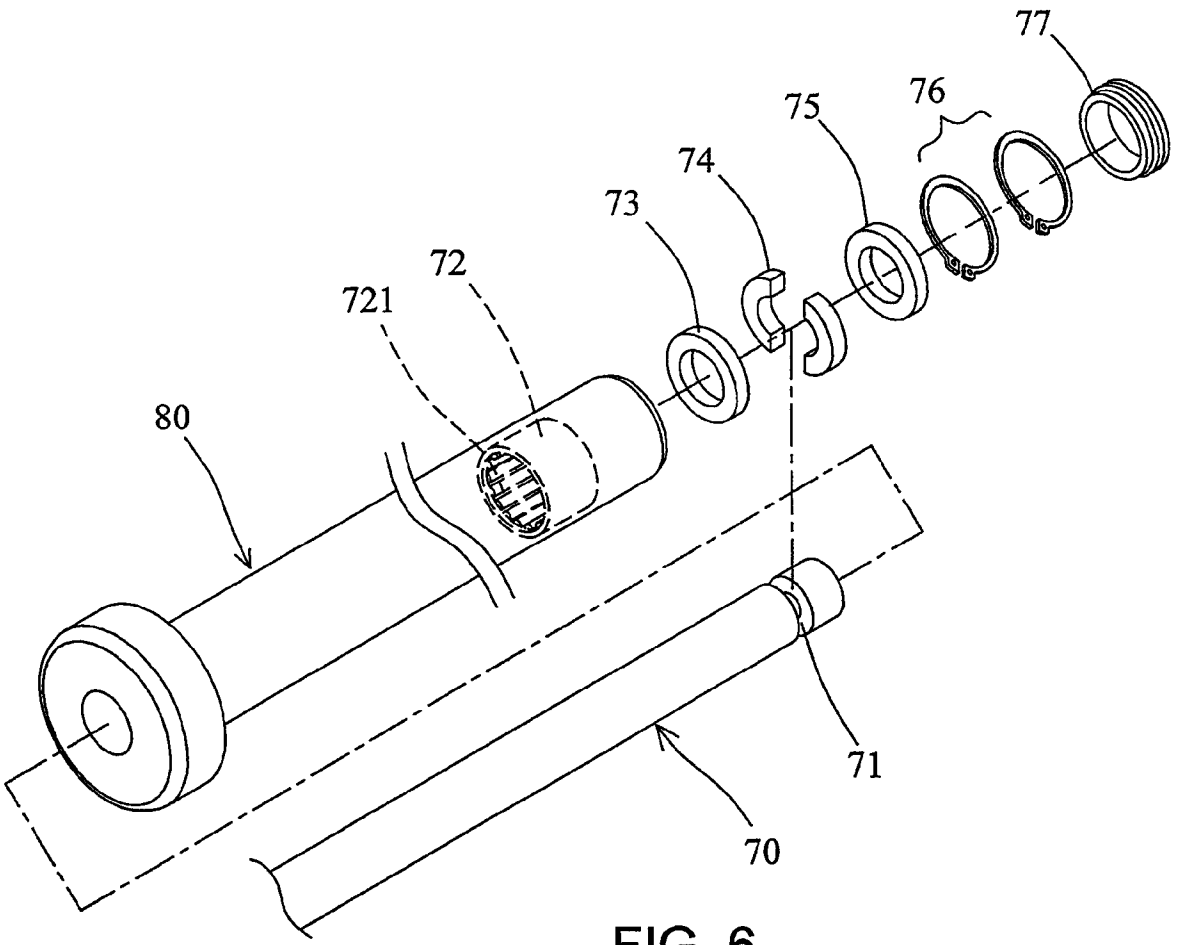
FIG. 6 PRIOR ART
FIG. 6 is an exploded view to show the conventional pivotal unit and the barbell.
Figure 7:
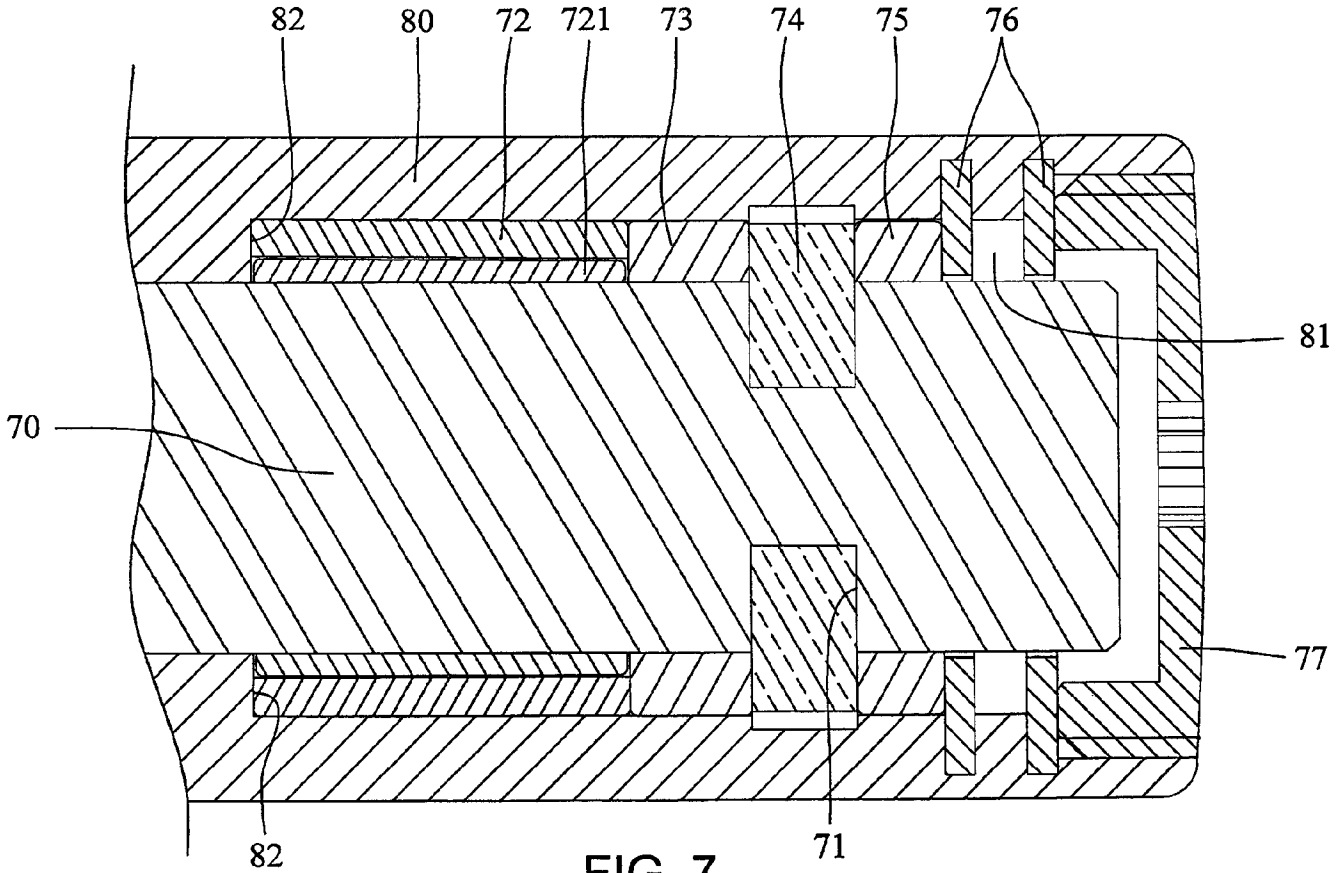
FIG. 7 PRIOR ART
FIG. 7 is an enlarged cross sectional view of the conventional pivotal unit and the barbell.

Referring to FIGS. 1 to 3, the barbell 1 of the present invention comprises a rod 10 and two grooves 11 are respectively defined in two ends of the rod 10. Two tubular members 20 are respectively mounted to the two ends of the rod 10 and the weights 12 are mounted to the tubular members 20. Each tubular member 20 has two open ends which are the first end and the second end.

Two pivotal units 30 are respectively located in the two tubular members 20 and mounted to the two ends of the rod 10. Each pivotal unit 30 has a first washer 31, a first bearing 32, a first sleeve 33, a positioning member 34 and an end piece 35 positioned in the first end of the tubular member 20. A second washer 310, a second bearing 320 and a second sleeve 330 are positioned in the second end of the tubular member 20. A stop 13 is mounted to the second end of the tubular member 20 to seal the second end of the tubular member 20 so as to prevent the second washer 310, the second bearing 320 and the second sleeve 330 from dropping from the second end of the tubular member 20. As shown in FIG. 1, the stop 13 also restrict the weight 12 mounted to the tubular member 20.

The first washer 31 has a first annular recess 311 defined in a first side thereof, a second side of the first washer 31 is stopped by a shoulder in the inner periphery of the tubular member 20. The first bearing 32 has first rollers 321 located at the inner periphery thereof. The first sleeve 33 is located in the first bearing 32 and rotatably and axially movably mounted to the rod 10. The first annular recess 311 is sized to accommodate one end of the first sleeve 33. The rod 10 has a groove 11 defined in each of the two ends thereof. The positioning member 34 is a C-shaped member and has an opening 341. The positioning member 34 is engaged with the groove 11 via the opening 341. Two ends of the first bearing 32 contact against the first washer 31 and the positioning member 34. The end piece 35 is threadedly connected to the inner threads 21 in the first end of the tubular member 20. The end piece 35 seals the first end of the tubular member 20 and prevents the first washer 31, the first bearing 32, the first sleeve 33 and the positioning member 34 from dropping from the first end of the tubular member 20. The end piece 35 contacts and pushes the positioning member 34 toward the first bearing 32. Therefore, the first washer 31, the first bearing 32, the first sleeve 33 and the positioning member 34 are well positioned by the end piece 35.

For the second end of the tubular member 20, the second washer 310 has a second annular recess 3110 defined in a first side thereof, and a second side of the second washer 310 is stopped by another shoulder in the inner periphery of the tubular member 20. The second bearing 320 has second rollers 3210 located at the inner periphery thereof. The second sleeve 330 is located in the second bearing 320 and rotatably and axially movably mounted to the rod 10. The second annular recess 3110 is sized to accommodate one end of the second sleeve 330. The two ends of the second bearing 320 contact against the second washer 310 and the stop 13. The first and second sleeves 33, 330 are located between the rod 10 and the first and second rollers 321, 3210 respectively. When the pivotal unit 30 is rotatable relative to the rod 10, the first and second sleeves 33, 330 protect the rod 10 from being worn out by the first and second rollers 321, 3210. It is noted that each of the first and second sleeves 33, 330 is made by a material the same as that of the first and second bearings 32, 320. Therefore, the first and second rollers 321, 3210 are moved on the first and second sleeves 33, 330 without creating any recessed portions in the first and second sleeves 33, 330, and the rod 10 is not directly in contact with the first and second rollers 321, 3210. The first and second sleeves 33, 330 are in contact with the rod 10 by a large area instead of multiple lines, so that the surface of the rod 10 is maintained in good condition. Therefore, no noise is generated when the pivotal units 30 are rotatable relative to the rod 10.

The first and second recesses 311, 3110 provides a space for the first and second sleeves 33, 330 to move so that the two ends of each of the first and second sleeves 33, 330 are not securely restricted by the washer 31 and the positioning member 34, and the first and second sleeves 33, 330 are rotatable relative to the first and second rollers 321, 3210 of the first and second bearings 32, 320 and the rod 10.

The positioning member 34 is a single member which can be easily and quickly engaged with the groove 11 of the rod 10 by the opening 341. This allows the assemblers to quickly assemble the barbell. The end piece 35 is connected to the first end of the tubular member 20 and the end piece 35 contacts the positioning member 34 so that the pivotal unit 30 is well positioned. The pivotal unit 30 is well arranged and the parts are well positioned so that when operating the barbell, no noise is generated.

While we have shown and described the embodiment in accordance with the present invention, it should be clear to those skilled in the art that further embodiments may be made without departing from the scope of the present invention.

What is claimed is:

1. A barbell comprising:

a rod having two ends, two tubular members respectively mounted to the two ends of the rod, each tubular member having two open ends which are a first end and a second end;

two pivotal units respectively located in the two tubular members and mounted to the two ends of the rod;

each pivotal unit having a first washer, a first bearing, a first sleeve and an end piece positioned in the first end of the tubular member, a second washer, a second bearing and a second sleeve being positioned in the second end of the tubular member, a stop mounted to the second end of the tubular member to seal the second end of the tubular member so as to prevent the second washer, the second bearing and the second sleeve from dropping from the second end of the tubular member;

the first washer having a first annular recess defined in a first side thereof, a second side of the first washer being stopped by a shoulder in an inner periphery of the first end of the tubular member, the first bearing having first rollers located at an inner periphery thereof, the first sleeve located in the first bearing and rotatably and axially movably mounted to the rod, the first annular recess being sized to accommodate one end of the first sleeve, the end piece being threadedly connected to inner threads in the first end of the tubular member, the end piece sealing the first end of the tubular member and preventing the first washer, the first bearing and the first sleeve from dropping from the first end of the tubular member;

the second washer having a second annular recess defined in a first side thereof, a second side of the second washer being stopped by another shoulder in an inner periphery of the second end of the tubular member, the second bearing having second rollers located at an inner periphery thereof, the second sleeve located in the second bearing and rotatably and axially movably mounted to the rod, the second annular recess being sized to accommodate one end of the second sleeve, two ends of the second bearing contacting against the second washer and the stop, the first and second sleeves located between the rod and the first and second rollers respectively, when the pivotal unit rotates relative to the rod, the first and second sleeves protect the rod from being worn out by the first and second rollers.

2. The barbell as claimed in claim 1, wherein the rod has a groove defined in each of the two ends thereof, each pivotal unit has a positioning member which is a C-shaped member with an opening, the positioning member engages with the groove via the opening, two ends of the first bearing contact against the first washer and the positioning member, respectively, the end piece contacts and pushes the positioning member toward the first bearing.

3. The barbell as claimed in claim 1, wherein the first and second sleeves and the first and second rollers are made of the same material.

* * * * *